US010220277B1

(12) United States Patent
Hunt et al.

(10) Patent No.: US 10,220,277 B1
(45) Date of Patent: Mar. 5, 2019

(54) DOUBLE-BARREL BALL BATS

(71) Applicant: EASTON DIAMOND SPORTS, LLC, Thousand Oaks, CA (US)

(72) Inventors: Linda Hunt, Simi Valley, CA (US); Grant Douglas, Santa Monica, CA (US); Dewey Chauvin, Simi Valley, CA (US); Ian Montgomery, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 15/894,365

(22) Filed: Feb. 12, 2018

(51) Int. Cl.

| | |
|---|---|
| ***A63B 59/51*** | (2015.01) |
| ***A63B 60/00*** | (2015.01) |
| ***A63B 60/54*** | (2015.01) |
| ***A63B 59/54*** | (2015.01) |
| ***A63B 59/42*** | (2015.01) |
| *A63B 102/18* | (2015.01) |
| *A63B 102/20* | (2015.01) |

(52) U.S. Cl.
CPC ..... *A63B 60/00* (2015.10); *A63B 59/42* (2015.10); *A63B 59/51* (2015.10); *A63B 59/54* (2015.10); *A63B 60/54* (2015.10); *A63B 2060/002* (2015.10); *A63B 2102/18* (2015.10); *A63B 2102/182* (2015.10); *A63B 2102/20* (2015.10); *A63B 2209/00* (2013.01); *A63B 2209/023* (2013.01)

(58) Field of Classification Search
CPC ..... A63B 59/51; A62B 59/54
USPC ..... 473/566, 567
See application file for complete search history.

(56) References Cited

U.S. PATENT DOCUMENTS

| | | | | |
|---|---|---|---|---|
| 3,877,698 A * | 4/1975 | Volpe | ..... | A63B 60/10 473/520 |
| 4,951,948 A | 8/1990 | Peng | | |
| 5,219,164 A * | 6/1993 | Peng | ..... | A63B 60/54 473/520 |
| 5,415,398 A | 5/1995 | Eggiman | | |
| 5,593,158 A | 1/1997 | Filice et al. | | |

(Continued)

OTHER PUBLICATIONS

ASTM International, "F2844-11: Standard Test Method for Displacement Compression of Softball and Baseball Bat Barrels" USA Baseball ABI Protocol, edition approved Apr. 1, 2011, published May 2011. 3 pages.

(Continued)

*Primary Examiner* — Mark Graham
(74) *Attorney, Agent, or Firm* — Perkins Coie LLP

(57) ABSTRACT

A method of making a ball bat may include forming a bat frame with a handle and an inner barrel structure, providing spacer elements extending radially outwardly from the inner barrel structure, and forming a barrel shell having a main barrel and a tapered section. An inner diameter in the tapered section may be equal to an outer diameter of a first one of the spacer elements. The method may include mechanically locking the barrel shell to the bat frame by passing the handle through the barrel shell and moving the barrel shell toward the inner barrel structure until the barrel shell contacts the first one of the spacer elements. A gap is maintained between an outer diameter of the inner barrel structure and the barrel shell. The barrel shell may deflect during a hit to create a trampoline effect, while the inner barrel structure limits the deflection.

10 Claims, 10 Drawing Sheets

(56) References Cited

U.S. PATENT DOCUMENTS

| | | | | |
|---|---|---|---|---|
| 6,053,828 | A | 4/2000 | Pitsenberger | |
| 6,159,114 | A | 12/2000 | Degaris | |
| 6,287,222 | B1 | 9/2001 | Pitsenberger | |
| 6,398,675 | B1 | 6/2002 | Eggiman et al. | |
| 6,461,260 | B1 | 10/2002 | Higginbotham | |
| 6,612,945 | B1 | 9/2003 | Anderson | |
| 6,761,653 | B1 | 7/2004 | Higginbotham et al. | |
| 6,869,372 | B1 | 3/2005 | Higginbotham et al. | |
| 6,949,038 | B2 | 9/2005 | Fritzke | |
| 6,969,330 | B1 * | 11/2005 | Meeker | A63B 59/54 473/567 |
| 6,997,826 | B2 | 2/2006 | Sutherland | |
| 7,014,580 | B2 | 3/2006 | Forsythe et al. | |
| 7,033,291 | B1 | 4/2006 | Meeker et al. | |
| 7,320,653 | B2 | 1/2008 | Fitzgerald et al. | |
| 7,527,570 | B2 | 5/2009 | Giannetti et al. | |
| 7,749,115 | B1 | 7/2010 | Cruz et al. | |
| 7,798,926 | B1 * | 9/2010 | Hsu | A63B 59/51 473/566 |
| 7,867,114 | B2 | 1/2011 | Sutherland et al. | |
| 7,980,970 | B2 | 7/2011 | Watari et al. | |
| 7,985,149 | B2 | 7/2011 | Watari et al. | |
| 7,993,223 | B2 | 8/2011 | Watari et al. | |
| 8,007,381 | B2 | 8/2011 | Watari et al. | |
| 8,313,397 | B2 | 11/2012 | Watari et al. | |
| 8,449,412 | B2 | 5/2013 | Vander Pol et al. | |
| 9,067,109 | B2 | 6/2015 | Goodwin et al. | |
| 2002/0091022 | A1 | 7/2002 | Fritzke et al. | |
| 2004/0166970 | A1 * | 8/2004 | Sutherland | A63B 59/52 473/567 |
| 2005/0143203 | A1 * | 6/2005 | Souders | A63B 59/51 473/564 |
| 2006/0258490 | A1 | 11/2006 | Fitzgerald et al. | |
| 2007/0155546 | A1 * | 7/2007 | Chauvin | A63B 59/00 473/520 |
| 2007/0202973 | A1 * | 8/2007 | Van Nguyen | A63B 59/51 473/564 |
| 2008/0064538 | A1 * | 3/2008 | McNamee | A63B 59/50 473/564 |
| 2009/0215559 | A1 * | 8/2009 | McNamee | A63B 59/50 473/567 |
| 2009/0280934 | A1 | 11/2009 | Watari et al. | |
| 2009/0280935 | A1 * | 11/2009 | Watari | A63B 59/51 473/566 |
| 2010/0113194 | A1 * | 5/2010 | Tokieda | A63B 59/51 473/566 |
| 2011/0105255 | A1 | 5/2011 | Watari et al. | |
| 2011/0172038 | A1 | 7/2011 | Watari et al. | |
| 2014/0073464 | A1 | 3/2014 | Van Nguyen et al. | |
| 2014/0080641 | A1 | 3/2014 | Epling et al. | |
| 2014/0080642 | A1 | 3/2014 | Epling et al. | |
| 2014/0272245 | A1 | 9/2014 | Livingston-Peters et al. | |
| 2015/0005114 | A1 | 1/2015 | Tsukamoto et al. | |
| 2015/0040349 | A1 | 2/2015 | Malia et al. | |
| 2015/0157908 | A1 | 6/2015 | Zhang et al. | |
| 2015/0360104 | A1 | 12/2015 | Chauvin et al. | |
| 2017/0340935 | A1 | 11/2017 | Gray et al. | |

OTHER PUBLICATIONS

ASTM International, "F2398-11: Standard Test Method for Measuring Moment of Inertia and Center of Percussion of a Baseball or Softball Bat" USA Baseball ABI Protocol, edition approved Apr. 1, 2011, published May 2011. 3 pages.

Composites World, "Carbon-Kevlar Hinge, Besting metal hardware in weight, thickness, 3X load capacity and 1 million fatigue cycles with no degradation," available at https://www.compositesworld.com/blog/post/carbon-kevlar-hinge-, Oct. 30, 2017. 7 pages.

European Space Agency "Passive Damped Deployment of Full Composite Structures" available at http://www.esa.int/Our_Activities/Space_Engineering_Technology/Shaping_the_Future/Passive_Damped_Deployment_of_Full Composite_Structures. Exact publication date unknown; website visited Feb. 9, 2018. 2 pages.

Russell, Ph.D., Daniel., "Explaining the 98-mph BBS standard for ASA softball" Pennsylvania State University, Graduate Program in Acoustics, available at http://www.acs.psu.edu/drussell/bats/bbs-asa.html, Exact publication date unknown, last modified May 12, 2008, website visited Feb. 12, 2018. 6 pages.

Tech Briefs "Locking Mechanism for a Flexible Composite Hinge" available at https://www.techbriefs.com/component/content/article/tb/techbriefs/mechanics-and-machinery/26023, Dec. 1, 2016. 7 pages.

Non-Final Office Action dated Aug. 7, 2015 in U.S. Appl. No. 14/307,312 of Hunt, L., et al. filed Jun. 17, 2014. 6 pages.

Response to Non-Final Office Action dated Dec. 7, 2015 in U.S. Appl. No. 14/307,312 of Hunt, L., et al. filed Jun. 17, 2014. 15 pages.

Final Office Action dated Jan. 21, 2016 in U.S. Appl. No. 14/307,312 of Hunt, L., et al. filed Jun. 17, 2014. 12 pages.

International Search Report and Written Opinion, dated Aug. 31, 2015, in International Application No. PCT/US2015/035959 of Easton Baseball/Softball Inc. filed Jun. 16, 2015. 7 pages.

* cited by examiner

DOUBLE-BARREL BALL BATS

BACKGROUND

Ball bats, particularly composite ball bats, have been designed with various stiffness properties to meet the preferences of various players. Many players, for example, prefer the feel and performance of ball bats having barrels that exhibit high compliance (for example, high radial deflection) and low stiffness. There are challenges, however, in making an effective, durable ball bat having these properties. In addition, there are challenges in making a ball bat with high compliance that can meet league or association rules, such as rules associated with the Bat-Ball Coefficient of Restitution ("BBCOR"), the Batted-Ball Speed ("BBS") value, or other rules associated with collision efficiency of a bat and a ball.

SUMMARY

Representative embodiments of the present technology include a method for making a ball bat. The method may include forming a bat frame with a handle and an inner barrel structure. The method may include providing two or more spacer elements extending radially outwardly from the inner barrel structure. The method may further include forming a barrel shell with one or more layers of composite laminate material. Forming the barrel shell may include forming a main barrel and a tapered section. An inner diameter in the tapered section may be equal to an outer diameter of a first one of the spacer elements. The method may further include mechanically locking the barrel shell to the bat frame by passing the handle through the barrel shell and moving the barrel shell toward the inner barrel structure until the barrel shell contacts the first one of the spacer elements such that a gap is maintained between an outer diameter of the inner barrel structure and the barrel shell.

Another method for making a ball bat may include providing a bat frame, the bat frame having a handle and an inner barrel structure, and positioning a release material on the inner barrel structure. The method may further include forming a barrel shell around the release material with one or more layers of composite laminate material, wherein forming the barrel shell includes forming the barrel shell to coextend with the inner barrel structure, and curing the one or more layers of composite laminate material of the barrel shell. The method may further include removing the barrel shell from the bat frame, removing the release material from the bat frame, providing a first spacer element to the bat frame, the first spacer element being positioned in a tapered region of the inner barrel structure, providing a second spacer element to the bat frame, the second spacer element being positioned adjacent to a distal end of the inner barrel structure, and positioning the barrel shell onto the inner barrel structure by first sliding the barrel shell over the handle and then onto the inner barrel structure. The first spacer element and the second spacer element maintain a gap between the barrel shell and the inner barrel structure. Positioning the barrel shell onto the inner barrel structure may include engaging the first spacer element with a tapered section of the barrel shell. In some embodiments, the gap may vary along a length of the inner barrel structure, for example, by varying an outer diameter of the inner barrel structure between the spacer elements.

Another representative embodiment of the present technology may include a ball bat having a frame with a handle and an inner barrel structure, the inner barrel structure including a tapered region joining the handle and the inner barrel structure. The ball bat may include a barrel shell with a proximal end and a distal end positioned opposite the proximal end, and a tapered section positioned adjacent to the proximal end. The barrel shell may include one or more layers of composite laminate material. The barrel shell may be positioned around the inner barrel structure and spaced apart from the inner barrel structure along at least a portion of a length of the barrel shell to form a gap between the barrel shell and the inner barrel structure. A mechanical locking feature may be provided and configured to retain or secure the barrel shell to the frame. The gap may generally have a uniform width along its length between spacer elements, or it may have a varying width. For example, the gap width may be narrower at a center of percussion of the ball bat.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to double-barrel ball bats, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats and composite materials, may not be shown or described in detail to avoid unnecessarily obscuring the relevant description of the various embodiments. Accordingly, embodiments of the present technology may include additional elements or exclude some of the elements described below with reference to FIGS. 1-6E, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to ball bats. Embodiments of the present technology can be used in baseball, softball, cricket, or similar sports.

Figure 1:
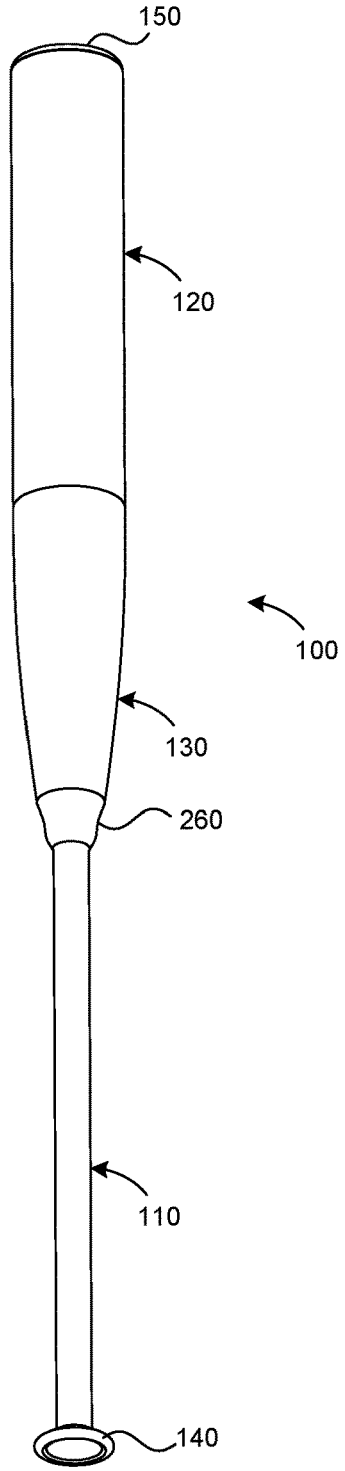
FIG. 1 illustrates a perspective view of a ball bat according to an embodiment of the present technology.

As shown in FIG. 1, a baseball or softball bat 100, hereinafter collectively referred to as a "ball bat" or "bat," includes a handle 110, a main barrel 120 (constituting at least part of a hitting surface), and a tapered section 130 joining the handle 110 to the barrel 120. The free end of the handle 110 optionally includes a knob 140 or similar structure. The main barrel 120 is optionally closed off by a suitable plug or end cap 150. The interior of the bat 100 is optionally hollow, allowing the bat 100 to be relatively lightweight so that ball players may generate substantial bat speed when swinging the bat 100.

The ball striking area of the bat 100 typically extends throughout the length of the main barrel 120, and may extend partially into the tapered section 130 of the bat 100. For ease of description, this striking area will generally be referred to as the "barrel" or "barrel region" throughout the remainder of the description. The barrel region generally includes a "sweet spot," which is the impact location where the transfer of energy from the bat 100 to a ball is generally maximal, while the transfer of energy to a player's hands is generally minimal. The sweet spot is typically located near the bat's center of percussion (COP), which may be determined by the ASTM F2398-11 Standard. Another way to define the location of the sweet spot is between the first node of the first bending mode and the second node of the second bending mode. This location, which is typically about four to eight inches from the free end of the bat 10, generally does not move when the bat is vibrating. For ease of measurement and description, the "sweet spot" described herein coincides with the bat's COP.

The proportions of the bat 100, such as the relative sizes of the main barrel 120, the handle 110, and the tapered section 130, are not drawn to scale and may have any relative proportions suitable for use in a ball bat. Accordingly, the bat 100 may have any suitable dimensions. For example, the bat 100 may have an overall length of 20 to 40 inches, or 26 to 34 inches. The overall main barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the ball bat 100, and may vary greatly among users.

The ball bat 100 may include two or more separate attached pieces (for example, a portion of the bat 100 that includes the handle 110 may be separate from, but attached to, a portion of the bat 100 that includes the main barrel 120. In some embodiments, a portion of the bat 100 that includes the handle 110 may include a portion of the tapered section 130, and a portion of the bat 100 that includes the main barrel 120 may also include a portion of the tapered section 130. In some embodiments, the portion of the bat 100 that includes the main barrel 120 may overlap with the portion of the bat 100 that includes the handle 110. In some embodiments, the tapered section 130 may be mostly or entirely included in the portion of the bat that includes the main barrel 120. As used herein, the "handle" and "barrel" may include portions of the tapered section 130.

In particular representative embodiments of the present technology, the ball bat 100 may be constructed from one or more composite or metallic materials. Some examples of suitable composite materials include laminate layers or plies reinforced with fibers of carbon, glass, graphite, boron, aramid (such as Kevlar®), ceramic, or silica (such as Astroquartz®). In some embodiments, aluminum, titanium, or another suitable metallic material may be used to construct some portions or all of the ball bat 100. For example, in some embodiments, the main barrel 120 may be formed with one or more composite or metal materials. The handle 110 may be formed from the same materials as the main barrel 120, or the handle 110 may be formed with different materials. In some embodiments, the handle 110 may be formed with a metal material and the main barrel 120 may be formed with a composite material.

Figure 2:
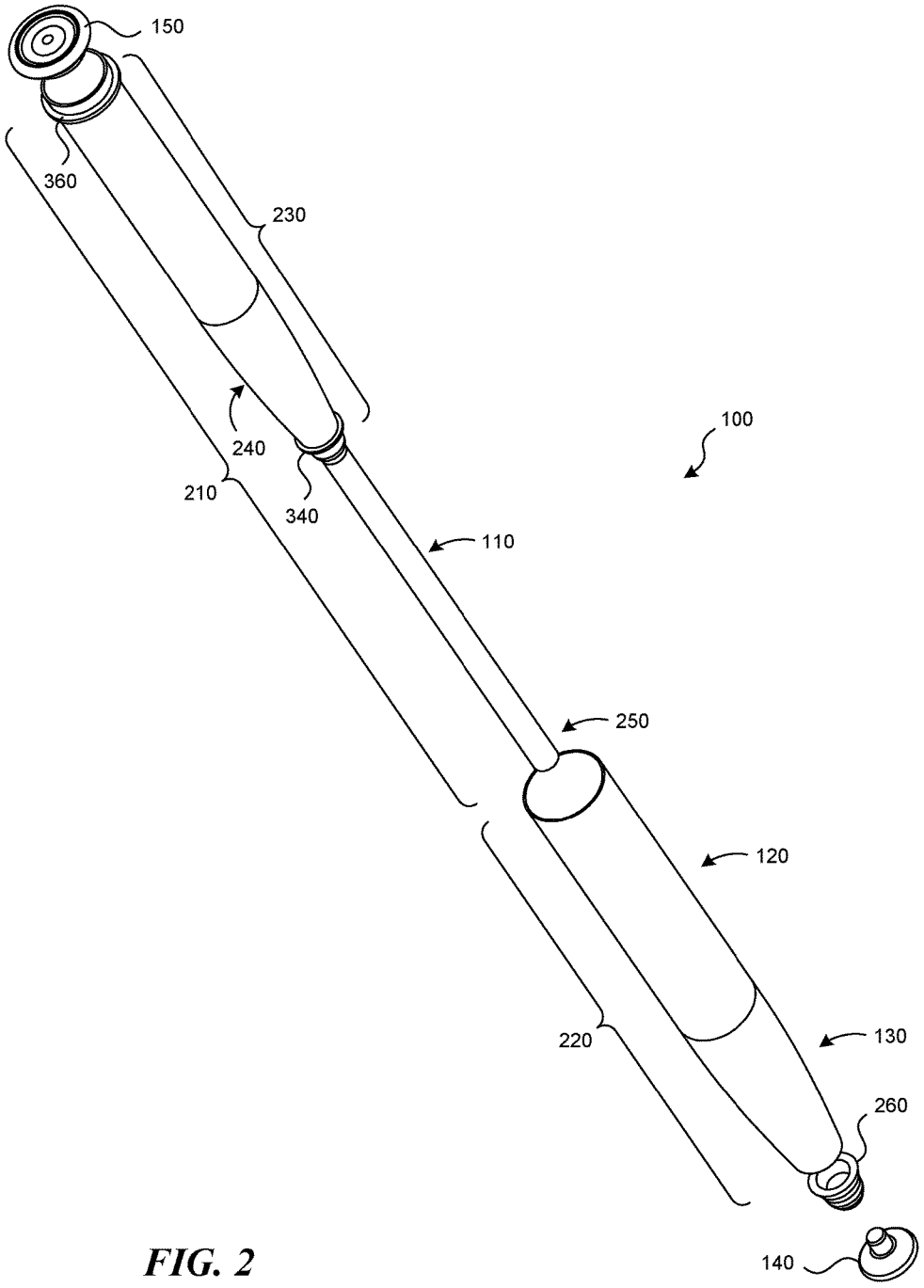
FIG. 2 illustrates a perspective exploded view of the ball bat shown in FIG. 1.

FIG. 2 illustrates a perspective exploded view of the ball bat 100 shown in FIG. 1. In some embodiments, the ball bat 100 includes a frame 210 and a barrel shell 220. The barrel shell 220 may be a generally hollow, tapered, cylindrical structure, and it may be positioned over and onto the frame 210, where it is mechanically locked with the frame 210 (as further described below). The barrel shell 220 may form an outer barrel in a double-barrel structure. The frame 210 may include the handle 110 and an inner cylindrical backstop or inner barrel structure 230, and it may generally resemble the shape of a ball bat. The handle 110 and the inner barrel structure 230 may be formed with separate components or they may be integral (for example, the frame 210 may be made a unitary, integral component using composite materials or a metal material, such as one or more of the materials described herein). One or both of the handle 110 and the inner barrel structure 230 may be hollow (for example, they may be formed in a cylindrical shape with one or more layers of composite materials, or with a metal material). The inner barrel structure 230 optionally includes a tapered region 240, which may have a shape that generally corresponds with the shape of the tapered section 130 of the barrel shell 220. For example, the tapered region 240 may gradually transition from the outer diameter of the inner barrel structure 230 to the smaller outer diameter of the handle 110.

The barrel shell 220 includes the main barrel 120 and it may include at least part of the tapered section 130. In some embodiments, the barrel shell 220 may be configured to coextend with the inner barrel structure 230. The barrel shell 220 may be made with composite materials described herein, and it may be made with the same or different materials as the inner barrel structure 230. For example, the barrel shell 220 may be made with plastic (with or without fiber reinforcement), thermoplastic composite reinforced with fibers (such as chopped fiber, very long fibers, or continuous fibers), or other composite materials described herein, such as laminate composite materials.

When assembled, as further described below, the barrel shell 220 is positioned over and onto the inner barrel structure 230. The end cap 150 is attached to the distal end of the barrel shell 220 or the frame 210. The optional end knob 140 may be attached to the proximal end 250 of the handle 110. An optional collar 260 (also visible in FIG. 1) may be positioned at an interface between the handle 110 of the frame 210 and the barrel shell 220. The collar 260 may serve an aesthetic purpose (for example, providing a smooth appearance for the bat 100), or one or more functional purposes (for example, assisting in locking the barrel shell 220 to the frame 210, or closing a gap between components to resist debris penetrating the assembly).

The barrel shell 220 forms an outer barrel that is substantially separated or spaced apart from the inner barrel structure 230 by a gap, which is illustrated and described below with regard to FIGS. 3A-3D, for example. As described in additional detail throughout this disclosure, the barrel shell 220 provides some compliance during a hit to create a trampoline effect, while the inner barrel structure 230 provides a backstop to limit the radial deflection of the barrel shell 220. Ball bats according to various embodiments of the present technology provide improved hitting feel and sound without substantially increasing swing weight. In addition, ball bats according to various embodiments of the present technology may provide reduced shock or vibration for improved player comfort.

Referring to FIGS. 3A-3D, a space or gap 310 is provided between the barrel shell 220 and the inner barrel structure 230. The gap 310 may result from the barrel shell 220 having a larger inner diameter 320 than an outer diameter 330 of the inner barrel structure 230 along at least portions of the length of the ball bat 100. In some embodiments, the gap 310 may extend along the bat 100 between the end cap 150 and the collar 260, with optional breaks or interruptions in the gap 310 formed by spacers or fillers, as described below.

In some embodiments, the gap 310 may have a gap width W that is generally uniform along all or part of its length (for example, at least 50%, or 100%, of the striking area). For example, in some embodiments, the gap width W may be between approximately 0.1 inches and 1.0 inch. In specific embodiments, the gap width W may be 0.10 inches, 0.125 inches, 0.140 inches, 0.50 inches, or another suitable dimension. Bat designers may select the gap width W based on several factors, such as the thickness or composition of the barrel shell 220. In one exemplary embodiment, a one-inch gap width W may be used in a ball bat 100 having an outer barrel diameter of 2.75 inches. In some embodiments, the gap width W may be greater than 150% of a thickness of the barrel shell 220. In yet further embodiments, the gap 310 may have a varying gap width W along its length.

The gap 310 between the barrel shell 220 and the inner barrel structure 230 may be maintained by one or more spacer elements positioned in the gap 310. For example, when the bat 100 is assembled, a first spacer element 340 may be positioned adjacent to a proximal end 350 of the barrel shell 220 (optionally, within the tapered section 130), and a second spacer element 360 may optionally be positioned adjacent to a distal end 370 of the barrel shell 220. The spacer elements 340, 360 may contribute to maintaining concentricity between the barrel shell 220 and the frame 210 or the inner barrel structure 230.

A representative example of a spacer element is illustrated in FIGS. 3A-3D. In some embodiments, each spacer element 340, 360 may be in the form of a partial or complete ring positioned between the barrel shell 220 and the inner barrel structure 230. In some embodiments, one or more of the rings forming the spacer elements 340, 360 may be discrete elements attached to the frame 210 or the inner barrel structure 230, or they may be integral with the frame 210 or inner barrel structure 230. For example, in some embodiments, the material forming the inner barrel structure 230 may be molded to include one or more contours or projections along the length of the inner barrel structure 230 to form the shape of the spacer elements 340, 360. In some embodiments, one or more of the rings forming the spacer elements 340, 360 may be attached to or integral with the barrel shell 220. In general, the spacer elements 340, 360 include projections extending radially outward from the inner barrel structure 230, or radially inward from the barrel shell 220.

The spacer elements 340, 360 may be made of any suitable material, and various materials may affect the bat's performance. For example, the spacer elements 340, 360 may be made of the same material as the barrel shell 220 or the inner barrel structure 230. In some embodiments, the spacer elements may be rigid, such that they may be formed with one or more plastic (with or without fiber reinforcement), metal (such as aluminum, steel, magnesium, titanium, or other suitable metals), or composite materials. In some embodiments, the spacer elements may be formed with one or more resilient elastomeric materials, such as foam, foaming adhesive, rubber, thermoplastic polyurethane (TPU), or other suitable resilient elastomeric materials. In a particular representative embodiment, elastomeric materials used in the present technology may include polyurethane foam having a density of approximately four pounds per cubic foot (the inventors determined that the damping characteristics of such a foam helps a bat designer comply with BBCOR or BBS regulations, in various exemplary configurations).

Additionally or alternatively, in some embodiments, one or more resilient elastomeric materials may be positioned in the gap 310 between the spacer elements 340, 360. Such elastomeric materials may include elastomeric materials described throughout this disclosure, or other suitable elastomeric materials. For example, an elastomeric material may partially or completely fill the gap 310 between the spacer elements 340, 360.

In a representative embodiment, a layer or band 395 of elastomeric material (including any elastomeric material described herein, or any other suitable elastomeric material) may be positioned to be centered directly in the middle of the spacer elements (340, 360), or near the center of percussion, or at any other suitable position along the striking area of the bat. In some embodiments, the band 395 of elastomeric material may be positioned on and around the inner barrel structure 230, or it may be positioned on and around the inner diameter 320 of the barrel shell 220. Such a band 395 of elastomeric material (whether positioned on the inner barrel structure 230, the barrel shell 220, or both) may have a thickness between approximately 0.003 inches and 0.250 inches, depending on designer preferences and the gap width W. In a particularly representative embodiment, the band 395 may be between approximately 0.010 inches and 0.10 inches thick. In some embodiments, the location and thickness of the elastomeric material may affect the net gap width and the performance of the bat, for example, by providing a different rebound speed in one part of the bat than another. The band 395 may have a length L between 0.75 inches and 3.0 inches along the length of the bat, or in some embodiments, 0.125 inches to 6.0 inches along the length of the bat, depending on placement and desired performance or feel.

When an elastomeric material is positioned in the gap 310, it may be positioned to completely fill the gap 310 along a radial direction between the barrel shell 220 and the inner barrel structure 230, or it may only partially fill the gap 310 between the barrel shell 220 and the inner barrel structure 230 along the radial direction. In some embodiments, the gap 310 is otherwise filled with air. In other embodiments, the gap 310 may be a sealed vacuum space.

In some embodiments, some or all of the inner barrel structure 230 itself may have elastomeric properties. For example, the inner barrel structure 230 within the interior of the barrel shell 220 may be formed from an elastomeric material, or it may be at least partially covered or coated with an elastomeric material, such as a urethane material, rubber, polyurethane, thermoplastic polyurethane, thermo-plasticized rubber, thermo-plasticized elastomer, or another suitable material. In some embodiments, elastomeric materials may have a hardness value of Shore 70A or less, for example, between shore 20A and shore 40D. In some embodiments, the barrel shell 220 may include elastomeric materials in a similar manner. For example, it may be coated with an inner lining formed with an elastomeric material. In some embodiments, a gap may still be located between the inner barrel structure 230 and the barrel shell 220, such that the elastomeric material is engaged only when the ball impact is of sufficient energy to cause the barrel shell 220 to bottom out against the inner barrel structure 230 or the elastomeric material.

In some embodiments in which the spacer elements 340, 360 are formed with soft, resilient, or elastomeric materials, or in which elastomeric materials are positioned in the gap 310 (such as the band 395 or any coatings or other elastomeric structures described above), such elastomeric materials can soften or dampen the impulse of the barrel shell 220 when it contacts the inner barrel structure 230 during the bat's 100 impact with a ball. Accordingly, ball bats 100 according to the present technology may comply with BBCOR or BBS regulations at least partially because the elastomeric materials tend to dampen and absorb energy during bat-ball impact. Increased damping characteristics of the materials selected for the spacer elements 340, 360, or elastomeric materials positioned in the gap 310, are associated with decreased BBCOR or BBS. Increased damping characteristics may also reduce shock felt by the player during a hit, or sound heard by the player during a hit, and may enhance bat durability.

The spacer elements 340, 360 may be positioned at any suitable locations along the length of the bat, and more or fewer than two spacer elements may be used. In a particular representative embodiment, a distance D1 between the spacer elements 340, 360 may be at least 25% of the overall length of the barrel shell 220 to correspond with all or part of the striking area. For example, the distance D1 may be 80% or more (such as 100%) of the overall length of the barrel shell 220 to allow the gap 310 between the spacer elements 340, 360 to correspond with most or all of the striking area. The spacer elements 340, 360 may have any suitable length or thickness to support the barrel shell 220.

In various embodiments of the present technology, materials and dimensions may be selected to create a desired level of flex and compression of the barrel shell 220 relative to the inner barrel structure 230 (for example, the amount of trampoline effect of the barrel shell 220). For example, the position, spacing, and composition of the spacer elements 340, 360, elastomeric materials in the gap 310, any elastomeric materials in or on the inner barrel structure 230 or barrel shell 220, the thickness and composition of material (s) forming the inner barrel structure 230, the thickness and composition of material(s) forming the barrel shell 220, or the width of the gap W may be selected individually or in various combinations to create the desired level of flex and compression of the barrel shell 220 relative to the inner barrel structure 230.

In the art of ball bat design, designers may measure compression values by determining the amount of force required to compress a cylinder or ball bat in a radial direction. For example, designers may rely on compression values based on testing under the ASTM F2844-11 Standard Test Method for Displacement Compression of Softball and Baseball Bat Barrels.

Compression values of the inner barrel structure 230 and the barrel shell 220 may be selected to tune the feel or trampoline effect of the assembled ball bat 100. In some embodiments, the barrel shell 220 may have a lower (such as significantly lower) compression value than the compression value of the inner barrel structure 230. In some embodiments, the barrel shell 220 may have a higher compression value than that of the inner barrel structure 230. The discussion of specific compression values below is only representative of the technology for illustration, and is based on measuring compression under the ASTM F2844-11 standard, at a location approximately 6 inches from the distal end of the inner barrel structure 230 or the barrel shell 220, which may correspond to within approximately 3 inches of the center of percussion of an assembled ball bat. Compression is generally measured in a location away from the spacer elements (340, 360).

In a particular representative embodiment of a fast-pitch softball bat, the barrel shell 220 may have a compression value between approximately 130 to 150 pounds, while the inner barrel structure 230 may have a compression value of approximately 190 pounds or more (such as 270 pounds). Some representative compression values or ratios that the inventors have discovered to provide improved or optimal performance and feel include, for example: (a) a barrel shell compression value of 130 pounds and an inner barrel structure compression value of 190 pounds, or a ratio of inner barrel structure compression to barrel shell compression between 140 percent and 150 percent; (b) a barrel shell compression value of 154 pounds and an inner barrel structure compression value of 195 pounds, or a ratio of inner barrel structure compression to barrel shell compression between 120 and 130 percent; (c) a barrel shell compression value of 220 pounds and an inner barrel structure compression value of 400 pounds, or a ratio of inner barrel structure compression to barrel shell compression between 180 and 190 percent; and (d) a barrel shell compression value of 240 pounds and an inner barrel structure compression value of 76 pounds, or a ratio of inner barrel structure compression to barrel shell compression between 25 and 35 percent.

In a particular representative slow pitch softball bat according to an embodiment of the present technology, the barrel shell 220 may have a compression value of approximately 50 pounds, while the inner barrel structure 230 may have a compression value of approximately 270 pounds, or there may be a ratio of inner barrel structure compression to barrel shell compression between 200 percent and 600 percent.

In some embodiments, in which a designer must comply with BBCOR or BBS requirements, higher compression values may be used. For example, compression values may be approximately 500 to 600 pounds or more, to approximate the BCCOR value of a solid wood baseball bat. In some embodiments, to maintain compliance with BBCOR or BBS limitations, the spacer elements 340, 360 may be soft (a softer connection between the barrel shell 220 and the inner barrel structure 230 correlates with lower performance). In general, compression values may be selected such that the final assembled ball bat 100 complies with league or association rules.

Embodiments of the present technology allow bat designers to create an overall bat assembly with a compression value less than 300 pounds while meeting performance limits set by various leagues and associations. A combination of performance and adherence to standards and rules, while maintaining durability, has been a challenge for bat designers in the past.

The barrel shell 220 may be mechanically locked to the frame 210 or the inner barrel structure 230 to prevent it from sliding off the frame 210 or the inner barrel structure 230 during use. A suitable mechanical locking feature may include a snap-ring configuration, a tongue-and-groove configuration, a projection on either the barrel shell 220 or the frame 210 and a corresponding notch in the other of the barrel shell 220 or the frame 210, or any other locking arrangement between the barrel shell 220 and the frame 210 or the inner barrel structure 230. In some embodiments, elastomeric materials or other materials positioned in the gap 310 may resist separation of the barrel shell 220 from the frame 210.

In some embodiments, the proximal end 350 of the barrel shell 220 may be tapered and configured to be in an overlapping, interference fit with a corresponding tapered region 240 of the frame 210. Such an overlapping interference fit may form a mechanical locking feature to secure the barrel shell 220 to the frame 210. More specifically, a proximally positioned inner diameter of the barrel shell 220 in the tapered section 130 of the ball bat 100 may be smaller than a more distally positioned outer diameter of the frame 210. In some embodiments, the spacer elements 340, 360 create the mechanical locking feature by providing an interference fit with the barrel shell 220. For example, an outer diameter of the first spacer element 340 may be equal to an inner diameter of the barrel shell 220 near the proximal end 350 of the barrel shell 220. The tapering of the barrel shell 220 in that part of the bat prevents the barrel shell 220 from sliding off the frame 210 in a distal direction. The coextensive tapers of the inner barrel structure 230 and the barrel shell 220 may also prevent the barrel shell 220 from sliding off the inner barrel structure 230 in a distal direction.

In some embodiments, the end cap 150 may be positioned to engage an inner diameter of the inner barrel structure 230 of the frame 210. The end cap 150 may close or cover a distal end of the gap 310. In some embodiments, the spacer element 360 adjacent to the distal end 370 may be omitted and the end cap 150 may include a projection or spacer extending into the gap 310 to maintain the spaced and concentric relationship between the barrel shell 220 and the inner barrel structure 230. Concentricity between the barrel shell 220 and the inner barrel structure 230, along with spacer elements such as the spacer elements 340, 360, may facilitate radial deflection of the barrel shell 220 without pivoting relative to the frame 210 during a hit.

Figure 3A:
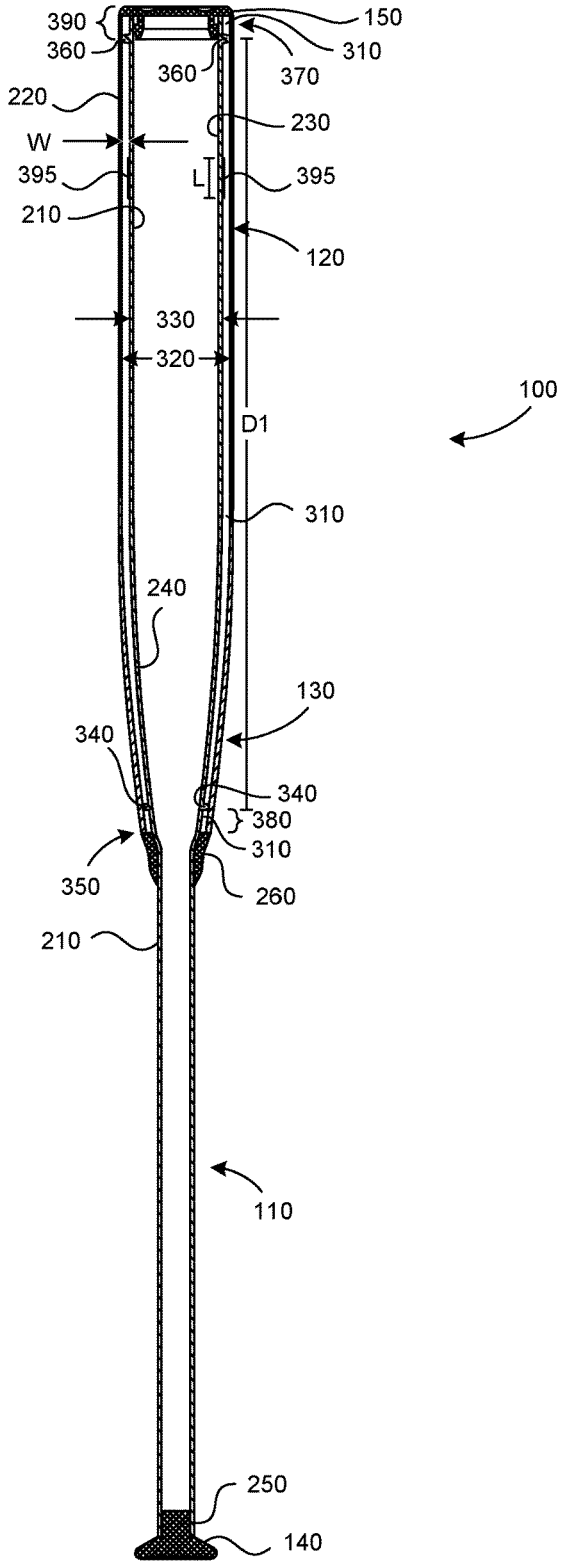
FIG. 3A illustrates a cross-sectional view of the ball bat shown in FIGS. 1 and 2 in an assembled configuration.
Figure 3B:
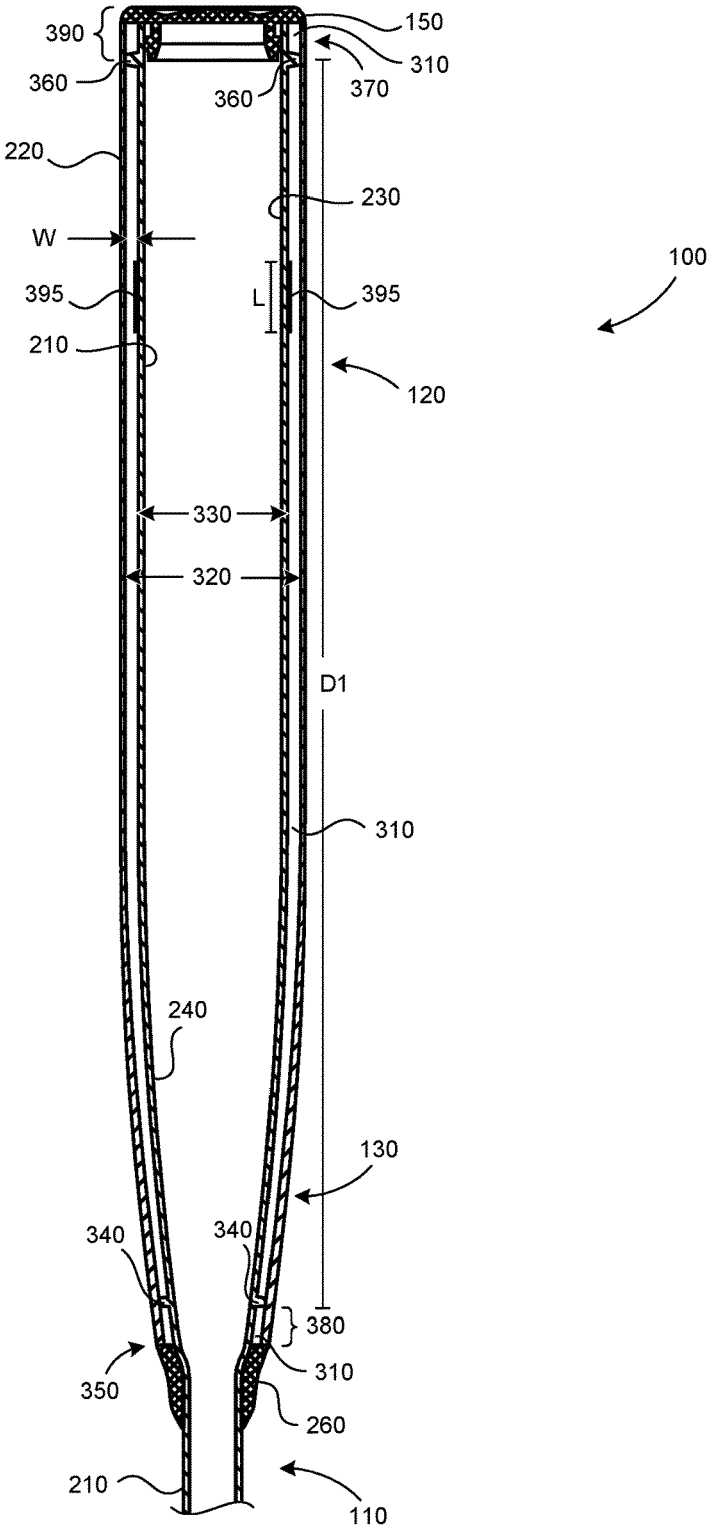
FIGS. 3B, 3C, and 3D each illustrate a portion of the ball bat shown in FIG. 3A.
Figure 3C:
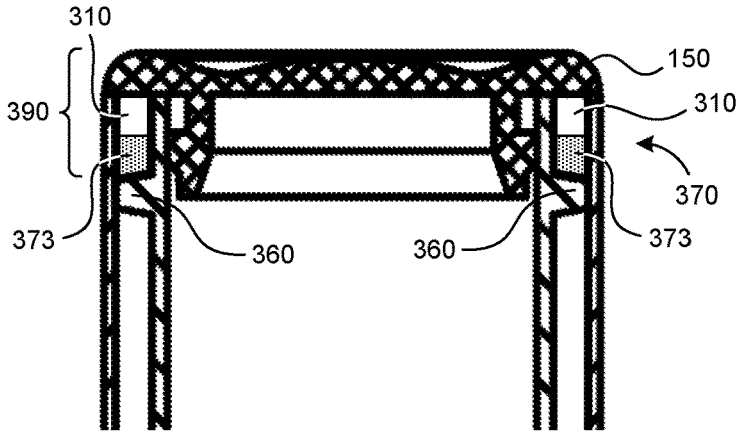
Figure 3D:
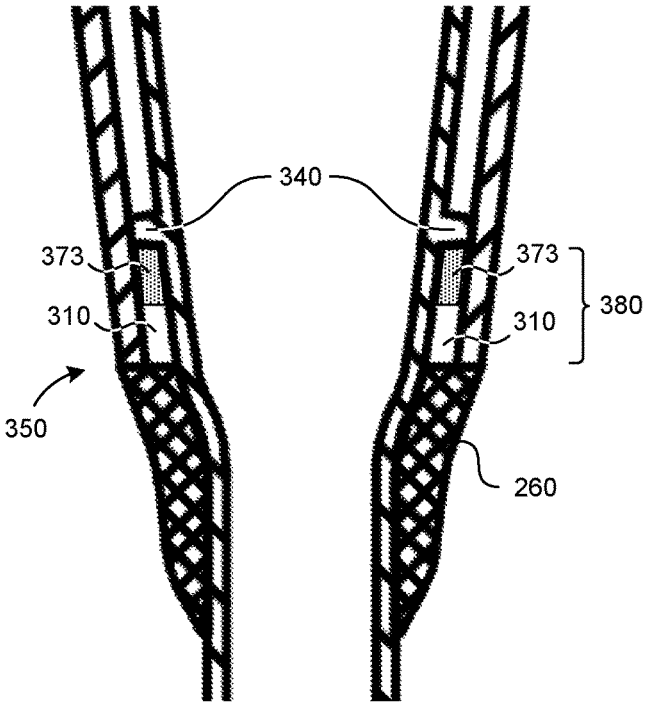

As shown in FIGS. 3C and 3D, in some embodiments, a ring 373 of elastomeric material may be positioned adjacent to one or more of the spacer elements 340, 360. The ring 373 may be positioned a space 380 between the first spacer element 340 and the proximal end 350 of the barrel shell 220 (outside the space between the spacer elements 340, 360) to support an overhanging part of the barrel shell 220 at its proximal end 350. The ring 373 may partially or completely fill the space 380. Likewise, another ring 373 of elastomeric material may be positioned in a space 390 between the second spacer element 360 and the distal end 370 of the barrel shell 220 (outside the space between the spacer elements 340, 360), to also support an overhanging part of the barrel shell 220 at its distal end 370. Although the ring 373 is described as being formed with an elastomeric material, it may be rigid in some embodiments. The ring 373 may prevent cracking or other damage at the proximal 350 and distal 370 ends of the barrel shell 220.

Figure 4A:
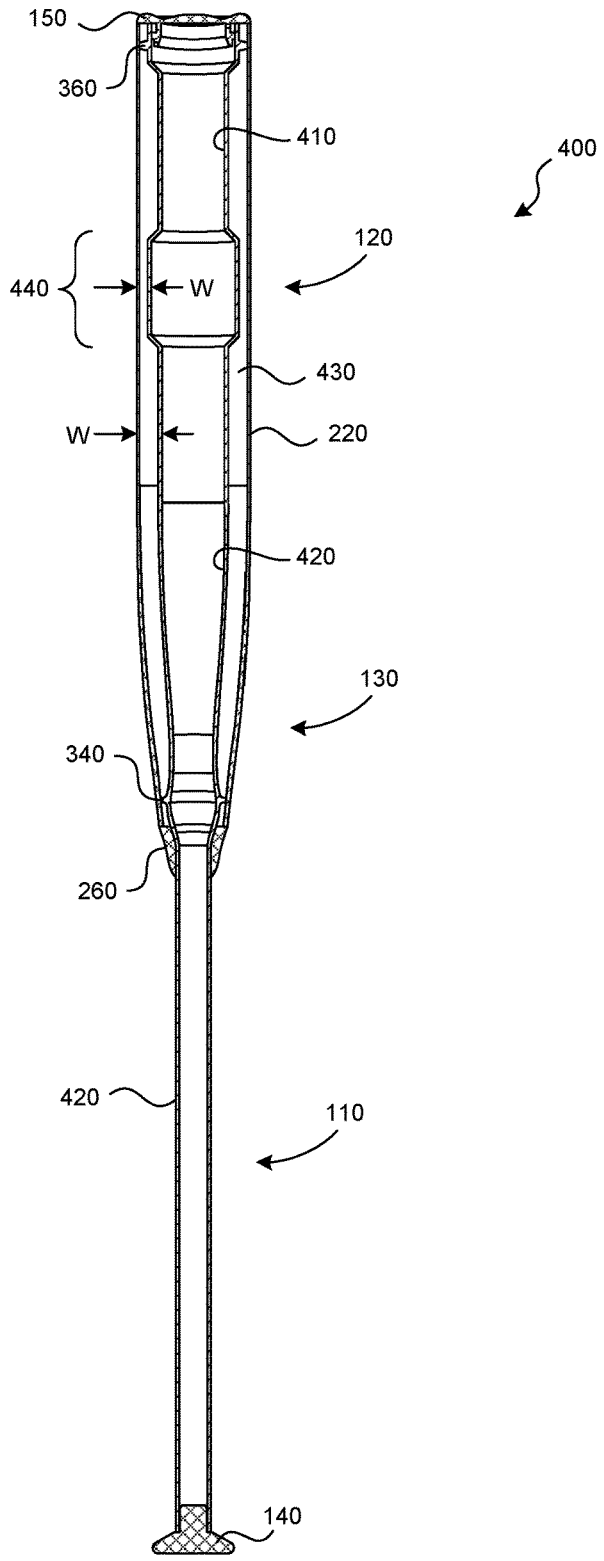
FIG. 4A illustrates a cross-sectional view of a ball bat according to another embodiment of the present technology.
Figure 4B:
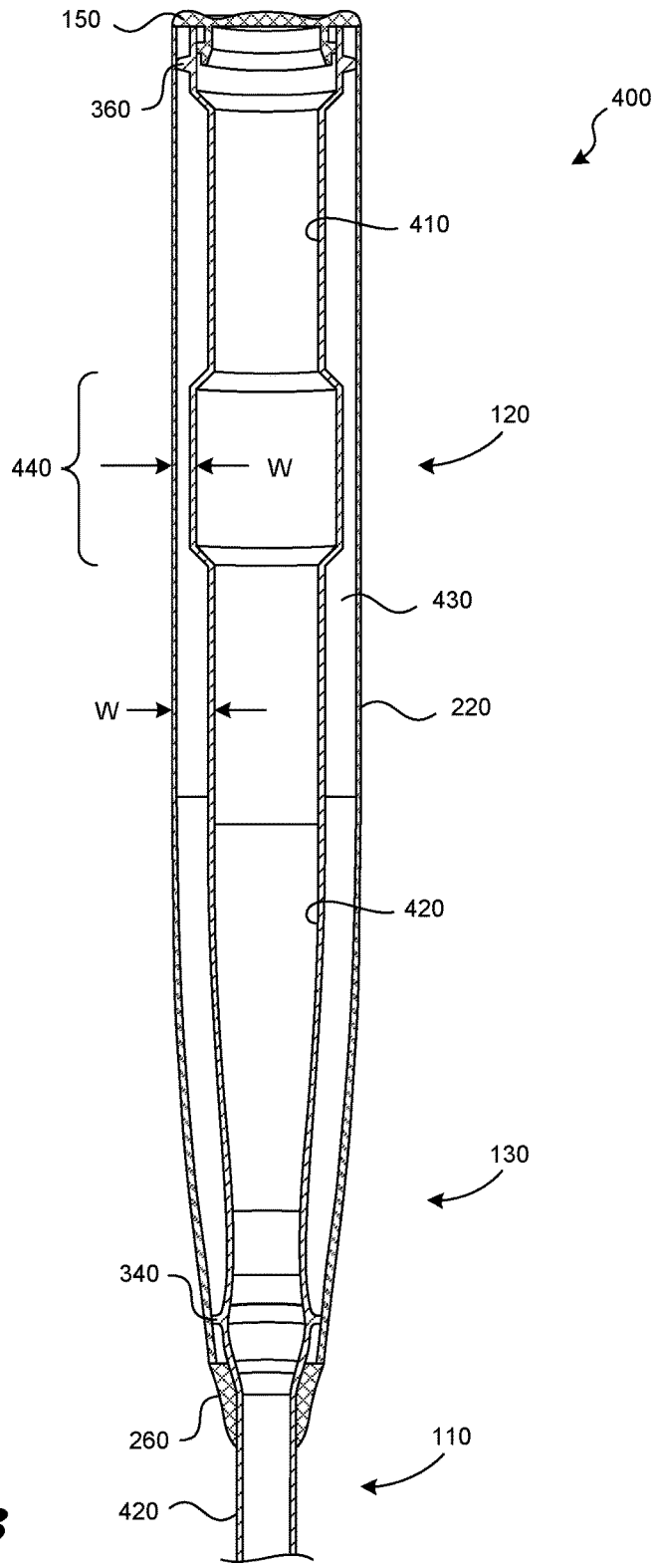
FIG. 4B illustrates a portion of the ball bat shown in FIG. 4A.

Referring to FIGS. 4A and 4B, a ball bat 400 is similar to the ball bat 100 described above with regard to FIGS. 1-3D in most aspects, except that the inner barrel structure 410 of the frame 420 has a shape or contour that creates a gap 430 of varying width W between the inner barrel structure 410 and the barrel shell 220. In some embodiments, the gap width W may be smaller in or near a chosen reference region 440 along the length of the barrel than in other locations along the length of the barrel. The gap width W may be varied by varying the outer diameter of the inner barrel structure 410 along its length. For example, the outer diameter of the inner barrel structure 410 may be larger in the reference region 440 than the outer diameter of other parts of the inner barrel structure 410.

In particular representative embodiments, the reference region 440 may include one or more of the striking area of the bat 400, the center of percussion, or other regions of the bat 400. In a more particular representative embodiment, the reference region 440 may span a two-inch distance from either side of the center of percussion.

The narrower gap width W may provide an area of reduced performance or BBCOR (or BBS) due to the outer barrel structure 220 being limited in the amount it can radially deflect or compress before being stopped by the inner barrel structure 410 during impact with a ball. For example, a ball bat 400 according to an embodiment of the present technology may be designed such that the gap 430 in the reference region 440 is relatively small, so that the bat 400 exhibits a BBCOR (or BBS, or other performance measurement) value that complies with regulations.

The gap 430 outside of the reference region 440 may facilitate increased trampoline effect and BBCOR (or BBS) relative to the gap 430 in the reference region 440 to enhance the overall bat performance along the length of the barrel, or to broaden the areas of the bat where peak performance can be achieved. Optionally, the gap width W may be selected to maintain compliance with performance limitations along the full length of the barrel. In some embodiments, the gap width W may be reduced to zero, or omitted, in the reference region 440.

Figure 5:
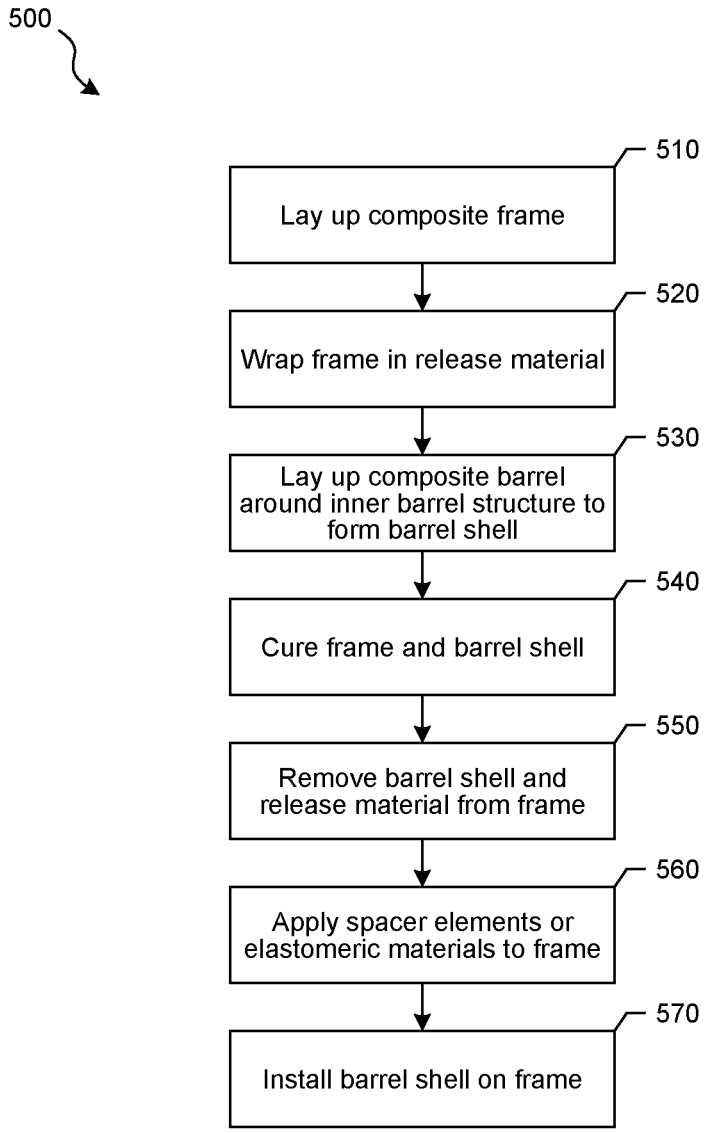
FIG. 5 is a flow chart illustrating a method of making ball bats according to an embodiment of the present technology.

Embodiments of the present technology also include methods of making double-barrel ball bats, including but not limited to the ball bats disclosed herein. FIG. 5 illustrates a method 500 of making ball bats according to the present technology. In block 510, composite laminate material may be laid up or otherwise positioned around a mandrel to form a frame (with or without the spacer elements described above). In block 520, a release material may be wrapped or otherwise positioned or applied around the inner barrel structure of the frame (which may be cured or uncured at this point in the method). The release material may have a thickness corresponding to the desired gap width between the frame or inner barrel structure and the barrel shell. The release material maintains the gap width during the manufacturing and curing process. The release material may include one or more of silicone sheet, elastomeric sheet, polyamide, cellophane, vinyl, polymer materials (such as PTFE), or other materials suitable to prevent bonding between the barrel shell and the frame during the molding and curing process. In some embodiments, the release material may be in the form of a tube or a sheet wrapped around or positioned on the frame.

In block 530, the method may include laying up further composite laminate material around the inner barrel structure of the frame to form the barrel shell (with or without spacer elements, as described above). In block 540, the frame and barrel shell may be cured. In block 550, the barrel shell may be removed by sliding it off the frame, for example, in a direction toward the handle. The release material prevents the barrel shell from becoming integral with the frame during the curing process. In block 550, the release material may also be removed from the frame.

In block 560, one or more spacer elements described above may be attached to the inner barrel structure of the frame as described above. In some embodiments, spacer elements may be formed in block 510 as part of the layup of the frame. In some embodiments, optional elastomeric materials described above may be attached or bonded to, or positioned around, the inner barrel structure of the frame or inside the barrel shell.

In block 570, the barrel shell may be slid back onto the frame and locked in place using one or more embodiments of mechanical locking arrangements described above (such as the corresponding coaxial tapers of the barrel shell and the inner barrel structure or the interference fit between the barrel shell and one or more spacer elements). Assembly of the barrel shell onto the frame according to embodiments of the present technology is described below with regard to FIGS. 6A-6C.

Figure 6A:
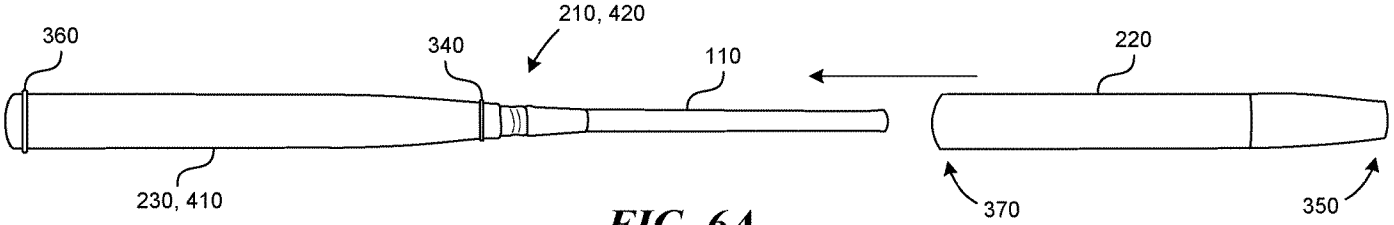
FIGS. 6A-6E illustrate stages of assembly of a ball bat according to an embodiment of the present technology.
Figure 6B:
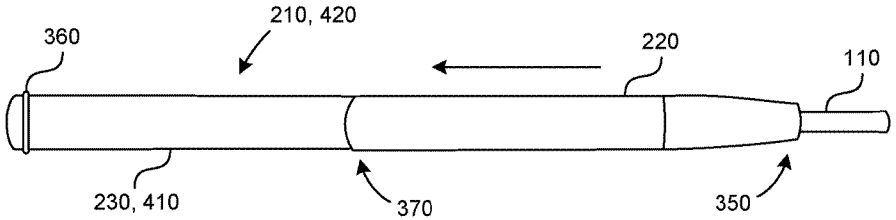
Figure 6C:
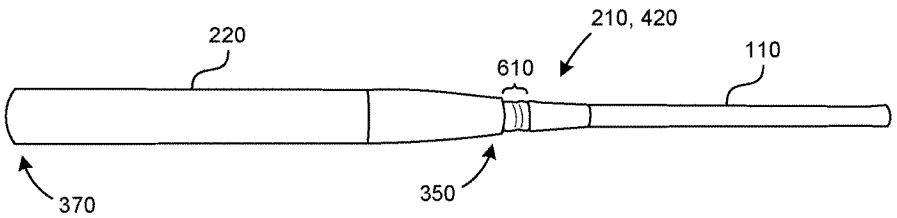

FIGS. 6A-6C illustrate assembly of the barrel shell 220 onto a frame (such as the frame 210 or 420 described above). As shown in FIGS. 6A and 6B, the barrel shell 220 is moved toward the frame (210, 420) such that the distal end 370 goes over and around the handle 110 first, followed by the proximal end 350. In some embodiments, before the barrel shell 220 is slid onto the frame (210, 420), spacer elements (such as the spacer elements 340, 360 described above) may be installed on the inner barrel structure (230, 410) of the frame (210, 420) or the barrel shell 220. In some embodiments, elastomeric materials may be applied on the inner barrel structure or the barrel shell, as described above. In other embodiments, one or more spacer elements or elastomeric materials may have previously been installed or integrally molded or formed with the inner barrel structure.

As shown in FIG. 6C, the barrel shell 220 is mechanically locked into position around the inner barrel structure of the frame (such as the inner barrel structures 230, 410, which are visible in FIGS. 6A and 6B but covered by the shell in FIG. 6C). As described above, a gap (such as the gaps 310 or 430) may be maintained between the frame or inner barrel structure and the barrel shell.

Figure 6D:
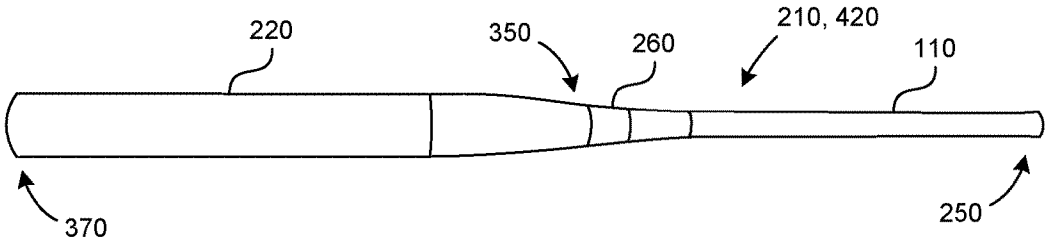
Figure 6E:
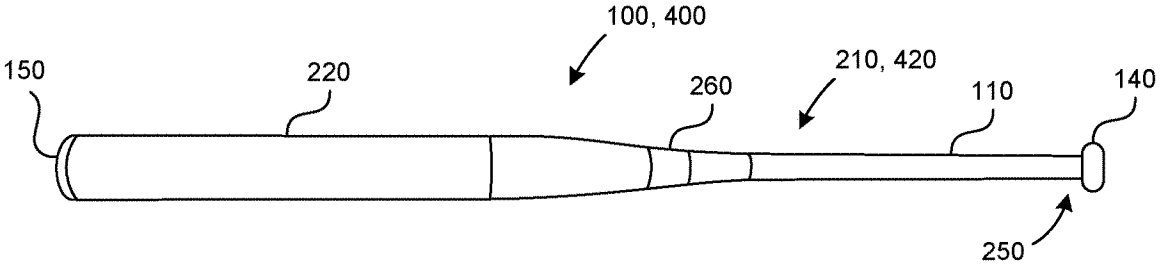

In some embodiments, an exposed area 610 may remain between the barrel shell 220 and the handle portion 110 of the frame (210, 420). The exposed area 610 may be left as-is, or it may be filled or otherwise covered for aesthetic purposes or for further improving the mechanical lock between the barrel shell 220 and the frame (210, 420). For example, as illustrated in FIG. 6D, a collar 260 may be positioned around the exposed area 610. FIG. 6E illustrates an embodiment of a complete bat (100, 400), which may include an optional knob 140 and cap 150 that may be installed at any suitable point during assembly of the bat.

In some embodiments, the barrel shell and frame may be molded separately from each other and then connected. In such embodiments, the frame may have spacer elements or elastomeric materials applied or installed prior to attaching the barrel shell to the inner barrel structure of the frame, or the frame may have spacer elements or elastomeric materials integrated therein.

With reference again to FIG. 5, in another embodiment, the inner barrel structure of the frame may be laid up in a manner similar to that described above with regard to block 510 of FIG. 5, but with one spacer element positioned near the tapered region of the inner barrel structure (240), such as the first spacer element (340) described above and show in various figures. After laying up the inner barrel structure according to such an embodiment, the inner barrel structure may be wrapped in a release material, or a release material may be otherwise applied in a manner similar to that described above with regard to block 520, such that the release material may have a thickness and length corresponding to the desired gap between the barrel shell and the inner barrel structure. Then, similar to the steps described above with regard to 530 and 540, the barrel shell may be laid up around the inner barrel structure and release material, sandwiching the release material between the inner barrel structure and the barrel shell, similar to the process described above. The assembly may then be cured.

After curing, the release material may be pulled out from between the barrel shell and the inner barrel structure, leaving the gap between the barrel shell and the inner barrel structure. The remainder of the ball bat may then be assembled in a manner similar to that described above with regard to FIGS. 6D and 6E. In some embodiments, the cap (such as the cap 150) may have a lip or spacer positioned between the inner barrel structure and the barrel shell to form a spacer element at the distal end of the ball bat.

In some embodiments, the frame may be made of metal. In such embodiments, the frame may be cast, machined, drawn, swaged, or otherwise made from metal, and then the barrel shell and other components may be added in a manner similar to that described with regard to FIGS. 6A-6E. In some embodiments, the frame may be made of wood and assembled in a manner similar to that described with regard to FIGS. 6A-6E.

Bats according to embodiments of the present technology provide improved feel and performance advantages for players. The gap between the frame (210, 420) and the barrel shell 220 facilitates a limited amount of "trampoline effect" that can be tailored with variation of the dimensions of the gap, materials used in the structures, and the spacer elements or materials in the gap. The barrel shell 220 exhibits compliance until it bottoms out against the inner barrel structure or materials in the gap. In some embodiments, the inner barrel structure exhibits some compliance. Accordingly, bats according to the present technology can have high or limited performance, improved feel, and improved durability as described herein.

Bats according to the present technology may be tamper-resistant in that a) the barrel shell is sufficiently flexible that typical "rolling" procedures (or other artificial break-in processes) may not affect the shell; b) deflecting the barrel shell so deeply in rolling to affect a change in the bat performance may damage the bat beyond use; or c) shaving or thinning of the frame or inner barrel structure may weaken or degrade the frame to a point where it may no longer be useful.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in bats intended for use in softball, the barrel shell may be formed with a very flexible composite material, which may provide high performance. In bats intended for use in baseball, where performance limitations may be lower or more regulated (such as in the NCAA or in USA Baseball, which regulate a lower performance value), the barrel shell may optionally be made of a metal material so that the barrel shell is more stiff (for example, as stiff as a solid wood bat).

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A method for making a ball bat, the method comprising:

forming a bat frame with a handle and an inner barrel structure;

providing two or more spacer elements on the inner barrel structure, the two or more spacer elements extending radially outwardly from the inner barrel structure;

positioning a release material on the inner barrel structure;

forming a barrel shell, over the release material, with one or more layers of composite laminate material, wherein forming the barrel shell comprises forming a main barrel and a tapered section, and forming the barrel shell comprises forming an inner diameter in the tapered section that is equal to an outer diameter of a first one of the spacer elements;

after curing the bat frame and barrel shell, removing the barrel shell from the bat frame and removing the release material; and replacing the barrel shell onto the inner barrel structure and mechanically locking the barrel shell to the bat frame by passing the handle through the barrel shell and moving the barrel shell toward the inner barrel structure until the inner diameter in the tapered section of the barrel shell contacts the first one of the spacer elements such that a gap is maintained between an outer diameter of the inner barrel structure and the barrel shell.

2. The method of claim 1, further comprising providing one or more elastomeric materials on the inner barrel structure between the barrel shell and the inner barrel structure.

3. The method of claim 1 wherein providing two or more spacer elements comprises forming the bat frame to include the spacer elements integral with the inner barrel structure.

4. The method of claim 1 wherein providing two or more spacer elements comprises providing two or more spacer elements comprising an elastomeric material.

5. The method of claim 1, further comprising providing a layer of elastomeric material around at least a portion of the inner barrel structure, wherein a thickness of the layer of elastomeric material is less than a width of the gap.

6. The method of claim 1 wherein forming the bat frame comprises forming a first part of the inner barrel structure to have a first outer diameter that is greater than a second outer diameter of any other part of the inner barrel structure, wherein when the barrel shell is positioned over the inner barrel structure, a portion of the gap adjacent to the first part of the inner barrel structure is smaller than other portions of the gap.

7. The method of claim 1, further comprising positioning a collar at an interface between the handle and the barrel shell.

8. The method of claim 1 wherein forming the barrel shell comprises forming the barrel shell to have a first compression value, and forming the bat frame with a handle and an inner barrel structure comprises forming the inner barrel structure to have a second compression value that is higher than the first compression value.

9. The method of claim 1 wherein forming the barrel shell comprises forming the barrel shell to have a first compression value, and forming the bat frame with a handle and an inner barrel structure comprises forming the inner barrel structure to have a second compression value that is lower than the first compression value.

10. A method for making a ball bat, the method comprising:

forming a bat frame with a handle and an inner barrel structure;

providing two or more spacer elements on the inner barrel structure, the two or more spacer elements extending radially outwardly from the inner barrel structure;

providing a layer of elastomeric material around at least a portion of the inner barrel structure;

forming a barrel shell with one or more layers of composite laminate material, wherein forming the barrel shell comprises forming a main barrel and a tapered section, and forming the barrel shell comprises forming an inner diameter in the tapered section that is equal to an outer diameter of a first one of the spacer elements; and mechanically locking the barrel shell to the bat frame by passing the handle through the barrel shell and moving the barrel shell toward the inner barrel structure until the inner diameter in the tapered section of the barrel shell contacts the first one of the spacer elements such that a gap is maintained between an outer diameter of the inner barrel structure and the barrel shell;

wherein a thickness of the layer of elastomeric material is less than a width of the gap.

* * * * *